US005783305A

United States Patent [19]

Masaki et al.

[11] Patent Number: 5,783,305

[45] Date of Patent: Jul. 21, 1998

[54] FINISH FOR CARBON FIBER PRECURSORS

[75] Inventors: Takao Masaki, Yamatotakada; Tomoo Komatsubara, Kashiwara; Yoshiaki Tanaka, Kitakatsuragi-gun; Seizi Nakanishi, Higashiosaka; Mikio Nakagawa; Junji Kanamori, both of Yao, all of Japan

[73] Assignee: Matsumoto Yushi-Seiyaku Co. Ltd., Osaka, Japan

[21] Appl. No.: 776,239

[22] PCT Filed: Aug. 30, 1996

[86] PCT No.: PCT/JP96/02435

§ 371 Date: Jan. 24, 1997

§ 102(e) Date: Jan. 24, 1997

[87] PCT Pub. No.: WO97/09474

PCT Pub. Date: Mar. 13, 1997

[30] Foreign Application Priority Data

Sep. 6, 1995 [JP] Japan ..... 7-228879

[51] Int. Cl.[6] ..... D01F 9/22

[52] U.S. Cl. ..... 428/408; 428/311; 428/375; 428/378

[58] Field of Search ..... 428/408, 361, 428/375, 378

[56] References Cited

U.S. PATENT DOCUMENTS

| | | | |
|---|---|---|---|
| 4,009,248 | 2/1977 | Kishimoto et al. | 423/447.4 |
| 4,522,801 | 6/1985 | Yoshinari et al. | 423/447.4 |
| 4,973,620 | 11/1990 | Ona et al. | 524/292 |

FOREIGN PATENT DOCUMENTS

| | | |
|---|---|---|
| 54-27097 | 3/1979 | Japan . |
| 54-27097A | 3/1979 | Japan . |
| 57-30425 | 6/1982 | Japan . |
| 63-135510 | 6/1988 | Japan . |
| 63-203878 | 8/1988 | Japan . |

*Primary Examiner*—Edward J. Cain
*Attorney, Agent, or Firm*—Stevens, Davis, Miller & Mosher, L.L.P.

[57] ABSTRACT

The invention provides an improved carbon fiber precursor finish which contains (A) the reaction product of a saturated aliphatic dicarboxylic acid and a monoalkyl ester of an alkylene oxide adduct of bisphenol A, to eliminate fluffs on precursors, and fused or broken precursors throughout stabilization and carbonization processes in carbon fiber production, and thus to provide precursors to be processed into quality high-performance carbon fibers.

13 Claims, No Drawings

FINISH FOR CARBON FIBER PRECURSORS

FIELD OF THE INVENTION

The present invention relates to a finish for the precursors to be processed into carbon fibers.

BACKGROUND OF THE INVENTION

Carbon fibers are produced in industrial processes from the precursors comprising polyacrylonitrile, rayon, polyvinyl alcohol, or pitch, which are converted into carbon fibers being subjected to oxidative stabilization at 250°–300° C. in oxygen, and then subjected to carbonization at 300°–2000° C. in an inert atmosphere. Carbon fibers are broadly applied as the fibrous materials to reinforce composites owing to their high performance.

In the above-mentioned industrial processes for carbon fiber production, the oxidative stabilization and the carbonization operation sometimes encounter troubles, such as adhered or fused precursors, fluffs on precursors, and precursor breakage due to the friction between precursors and machinery surface. Such troubles lead to poor quality and performance of the resultant carbon fibers.

The above-mentioned troubles are variable depending on the finish variants applied to precursors. For example, finishes having poor heat resistance fail to prevent precursors from adhesion or fusion, and related defect on precursors.

Various methods for eliminating such adhered or fused precursors and defect on precursors by applying silicone oils have already been proposed in the prior arts, for example, those disclosed in Japanese Patent Publication No. 24136 of 1977 (U.S. Pat. No. 4,009,248), Japanese Patent Laid-Open Nos.135510 and 203878 of 1988, and Japanese Patent Laid-Open No.306682 of 1989 (U.S. Pat. No. 4,973,620). The high heat-resistance, sufficient lubricity between fiber strands, and high detachability of silicone oils are well known to those skilled in the art. And the prior arts, including patent publications, have already proved that the said performance of silicone oils are effective to decrease adhered or fused precursors to some extent throughout the conversion process of carbon fiber production.

On the other hand, the strong hydrophilicity of silicone oils is apt to accumulate static charge on the precursors applied with silicone oils. The static charge on precursors causes fluffs, wraps on rolls or guides, and precursor breakage in the production process of precursors or in the conversion processes in carbon fiber production leading to decreased production efficiency. In addition, a part of silicone oils changes into silicon oxide in the oxidative stabilization of precursors, or into silicon nitride in the subsequent carbonization in nitrogen atmosphere. The silicon oxide and silicon nitride deposit on carbon fibers or in furnaces resulting in poor carbon fiber quality or damaged furnaces.

A production method of high-performance carbon fiber is disclosed in Japanese Patent Laid-Open No.264918 of 1988 (U.S. Pat. No. 4,522,801), wherein an acrylonitrile precursor subjected to oxidative stabilization is applied with an aqueous preparation containing a polyethylene oxide of which molecular weight is more than 100,000, a cellulose etherified with ethylether or hydroxyethylether, and/or polyvinyl methylether, and dried before the precursor is fed to carbonization process. In the said patent, the preparation is described to be effective for improving the cohesion of precursors so as to prevent fluffs of the bundle of precursors, to separate adhered precursors, and to prevent damage on precursor surface. However, the polyethylene oxide and other components in the aqueous preparation are not satisfiably heat resistant for preventing precursors from adhesion, while they impart sufficient cohesion to precursors.

In Japanese Patent Laid-Open No. 30425 of 1982, a heat-resistant finish for synthetic fibers including polyamide and polyester fibers, is disclosed. The high heat resistance of the finish contributes to no generation of fume or tar-like residue, a pollutant in working area, at each heating step throughout fiber production process and down-stream processing stages. The said patent includes the finish comprising the reaction product of a saturated aliphatic dicarboxylic acid, and a monoalkyl ester of an ethylene oxide and or propylene oxide adduct of bisphenol A; and an ethylene oxide adduct of bisphenol A. In addition, the said patent includes the finish formula containing an ethylene oxide/propylene oxide copolymer besides the said components. The examples of the patent explain the synthetic fiber applied with the heat-resistant finish is heated and drawn on a heater plate controlled at 180° C. and 190° C., and the heat resistant finish is tested by heating at 230° C. for 3 hours.

The applicants had studied on the possibility of applying the said heat-resistant finishes and their components to carbon fiber precursors to be subjected to the carbonization process, a completely different step from those in synthetic fiber production. Surprisingly, the finishes of the said patent displayed superior performance as the finish for carbon fiber precursors. The precursors applied with the finishes did not give fluffs, and broken or adhered precursors through carbonization process conducted at high temperature resulting in less deposit accumulation than the precursors applied with the conventional precursor finishes.

SUMMARY OF THE INVENTION

The present invention provides a carbon fiber precursor finish of high quality and performance, for satisfying the requirements mentioned above.

The present invention provides a carbon fiber precursor finish comprising 20 or more percent by weight of (A) the reaction product of a saturated aliphatic dicarboxylic acid, and a monoalkyl ester of an ethylene oxide and/or propylene oxide adduct of bisphenol A.

The present invention provides a carbon-fiber precursor finish comprising the above-mentioned component (A); and one or both of 20 to 50 percent by weight of (B) the component produced by the reaction of a condensate of a dibasic acid and a polyol containing alkylene oxide, and fatty acid alkylol amide, and 5 to 30 percent by weight of (C) an alkylene oxide adduct of an amide produced with the reaction of a polyamine and a fatty acid.

The present invention also provides a carbon fiber precursor finish containing 5 to 30 percent by weight of (D) the mixture of 0 to 100 parts by weight of an ethylene-oxide adduct of bisphenol A, and 0 to 100 parts by weight of an ethylene oxide/propylene oxide copolymer in addition to the above-mentioned components.

And the present invention provides a carbon fiber precursor finish, which is an aqueous emulsion of 20 to 60 percent by weight of component (A), 20 to 50 percent by weight of component (B), 5 to 30 percent by weight of component (C), and 5 to 30 percent by weight of component (D).

The finish of the present invention is resistant against heat and forms finish film on fiber surface so as to impart superior detachability between fiber strands, owing to the property of component (A), the reaction product of a saturated aliphatic dicarboxylic acid, and a monoalkyl ester of an ethylene oxide and/or propylene oxide adduct of bisphenol A. In addition, the high molecular weight amide, the said component (B), improves the spreadability of the said finish on polyacrylonitrile precursors so as to promote the forming of uniform finish film on precursor surface. The finish film protects precursor surface from heat and eliminate the adhesion, fusion, and defect of precursors through the heating steps in carbon fiber production. Such finish performance remarkably minimizes the troubles relating to the above-mentioned defect.

DETAILED DESCRIPTION OF THE INVENTION

The said component (B) of the finish of the present invention is produced by bonding the condensation product of a dibasic acid and a polyol containing alkylene oxides to the terminal of an aliphatic alkylol amide.

The said dibasic acid forming the above condensation product is selected from the group consisting of fumaric acid, maleic acid, itaconic acid, succinic acid, adipic acid, sebacic acid, phthalic acid, and thiodipropionic acid. Preferred are saturated dibasic acids, such as adipic acid and sebacic acid.

The said polyol containing alkylene oxides and forming the above condensation product (hereinafter referred as polyols, being distinguished from polyhydric alcohols without alkylene oxides, for example, glycerine, hereinafter referred as polyhydric alcohols) is selected from the group consisting of polyether polyols and ester polyols, both of which are the alkylene oxide adducts of the compounds having 2 or more active hydrogen radicals.

The said polyether polyols of the present invention are selected from the group consisting of cellosolves, which are the alkylene (such as ethylene or propylene) oxide adducts of polyhydric alcohols; and polyalkylene glycols, such as polyethylene glycol and polytetramethylene glycol. And the said ester polyols are the polyols having 1 or more ester bonds in their molecules. The average molecular weight of the ester polyols is from 500 to 10,000, and preferred is from 1,000 to 5,000.

The said compounds having 2 or more active hydrogen radicals to be formed into the said polyols are aliphatic polyhydric alcohols and polyhydric phenols, and preferred are aliphatic polyhydric alcohols. The aliphatic polyhydric alcohols are selected from the group consisting of diols, such as ethylene glycol, 1,4-butane diol, and 1,6-hexane diol, and monoglycerides; triols, such as glycerine, trimethylol propane, and pentaerythritols; and castor oil.

The alkylene oxides contained in the said polyols of the said condensation product are $C_2$–$C_4$ alkylene oxides, i.e., ethylene oxide(EO), propylene oxide(PO), and butylene oxide(BO). Two or more variants of the said alkylene oxides can be added to form the polyols in either random or block copolymer. Preferred alkylene oxide is ethylene oxide(EO).

The fatty acids of the fatty acid alkylol amide to be formed into the said component (B) are saturated or unsaturated $C_8$–$C_{30}$ fatty acids. Preferred are $C_{12}$–$C_{22}$ fatty acids. The fatty acids having $C_8$ or less form the amides of poor heat resistance, and the fatty acids having $C_{30}$ or more form the amides of poor miscibility in water, contrary to the aim of the present invention. Preferable alkylol amines to be formed into the said fatty acid alkylol amides are monoethanol amine, diethanol amine, monoisopropanol amine, diisopropanol amine, and monobutylethanol amine.

The condensation product of the dibasic acid and the polyol to be formed into the component (B) of the present invention is polycondensed (esterified) in a conventional method known to those skilled in the art, such as the esterification at 130°–220° C. under atmospheric pressure with catalysts, e.g., p-toluene sulfonic acid, hypophosphite, or alkyltitanate. The preferable ratio of the polyol to the dibasic acid for the esterification is 0.15–0.95 to 1 based on the equivalent weight of hydroxyl groups in the polyol to carboxyl groups in the dibasic acid, and most preferable ratio is 0.3–0.8 to 1. The acid value of the resultant polycondensate should be controlled within the range from 20 to 60.

The said condensation product and fatty acid alkylol amide is reacted into the component (B) of the present invention in the conventional method known to those skilled in the art. The acid value of the resultant component should be controlled at 5 or less.

The amide to be formed into the said alkylene oxide adduct (C) of the present invention is produced from the reaction of polyamines and fatty acids. The ratio of the polyamine to the fatty acid should be controlled to leave about 1 amino group (in average) per one molecule of the resultant amide for further addition of alkylene oxide. The polyamine forming the said amide is selected from the group consisting of ethylene diamine, diethylene triamine, triethylene tetramine, and phenylene diamine. The fatty acid forming the amide is selected among $C_8$–$C_{30}$ fatty acids. Preferred are $C_{12}$–$C_{22}$ fatty acids, and more preferred are the saturated $C_{12}$–$C_{22}$ fatty acids. The fatty acids of $C_8$ or less give the alkylene oxide adducts of poor heat resistance, and the fatty acids of $C_{30}$ or more give the alkylene oxide adducts (C) of poor miscibility in water The alkylene oxides to be added to the said amide are the $C_2$–$C_4$ alkylene oxides, i.e., ethylene oxide(EO), propylene oxide(PO), and butylene oxide(BO). Two or more variants of the said alkylene oxides can be added to form the adduct in either random or block copolymer. Preferred alkylene oxide is ethylene oxide. The number of the alkylene oxide monomers to be added to one molecule of the amide is from 5 to 100, and preferred is from 10 to 30. The adducts with less than 5 alkylene oxide monomers do not disperse well in water, and those with more than 100 alkylene oxide monomers have poor heat resistance and poor affinity to precursors.

The said component (A), the reaction product of a saturated aliphatic dicarboxylic acid, and the monoalkyl ester of an ethylene oxide and/or propylene oxide adduct of bisphenol A, is represented by the general formula I;

Formula I

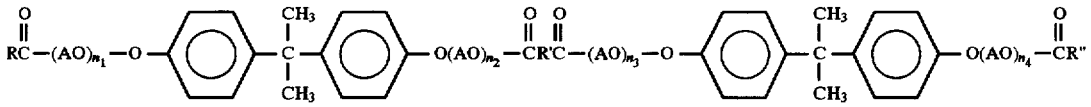

(I)

wherein R, R', and R" are the same or different alkyl groups; $n_1$, $n_2$, $n_3$, and $n_4$ are the same or different integer; and AO is an alkylene oxide group.

The preferable carboxylic acids containing R or R" are the higher fatty acids having 8 to 22 carbon number, preferably 12 to 18, such as lauric acid, miristic acid, palmitic acid, stearic acid, and oleic acid. The preferable saturated dicarboxylic acids containing R' are the dicarboxilic acids having 4 to 10 carbon number, such as adipic acid, pimelic acid, succinic acid, azelaic acid, and sebacic acid. The preferable alkylene oxide groups expressed as AO in Formula I, are those generated through the addition reaction of bisphenol A with $C_2$–$C_4$ alkylene oxides to form the alkylene oxide adduct of bisphenol A. The preferable alklylene oxide for the addition reaction is ethylene oxide, of which adduct of bisphenol A gives little scum in carbon fiber production. And the preferable number of the alkylene oxide monomers to be added to one molecule of bisphenol A ranges from 1 to 5, more preferably from 2 to 4. More alkylene oxide monomers added to bisphenol A will reduce the high heat resistance of the resultant component (A), represented by the above formula, of the present invention. High heat resistance is essential for carbon fiber precursor finishes, and in this case the high heat resistance is defined as that 50% or more finish will remain on precursors after heating at 280° C. for 1 hour, the simulation of carbonization process in fiber production. The component (A) can be formed in the conventional esterification process known to those skilled in the art, such as the esterification at 130°–220° C. under normal atmospheric pressure with the catalyst, such as p-toluene sulfonate, hypophosphite, and alkyltitanate.

The most preferable materials for producing the component (A) are azelaic acid, and the monopalmitate of the 2-mol polyoxyethylene adduct of bisphenol A. The component (A) produced with those materials is liquid at normal temperature, and has high heat resistance, which allows the component to be liquid after heating at 280° C. for 2 hours. Owing to such performance, the component (A) spreads uniformly on precursor surface, and prevents precursor strands from adhering to each other at high temperature.

The ethylene oxide adduct of bisphenol A contained in the mixture (D) of the present invention is represented by the formula II;

Formula II

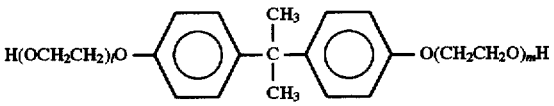

(II)

wherein l+m=10 to 100. The preferred number of ethylene oxide monomers for achieving satisfiable emulsification and heat resistance of the resultant adduct is from 30 to 80.

The preferable ethylene oxide/propylene oxide copolymer, as the other component of the mixture (D) of the present invention, must contain from 90 to 70 ethylene oxide and from 10 to 30 propylene oxide by molar ratio. And the preferable molecular weight of the copolymer is within the range from about 6,000 to about 12,000. Such copolymer contributes to satisfiable emulsification and heat resistance.

The mixture (D) of the present invention, comprising the ethylene oxide adduct of bisphenol A and ethylene oxide/propylene oxide copolymer, enables to make up an emulsion of component (A) of the present invention, which is hard to be emulsified with conventional emulsifiers. The mixture (D) functions as an emulsifier of superior heat resistance, which disperses the component (A) into a stable aqueous emulsion without affecting the heat resistance of the component (A).

The ratio of the ethylene oxide adduct of bisphenol A to the ethylene oxide/propylene oxide copolymer in the mixture (D) is within the range from 10:90 to 90:10, and the preferred is from 40:60 to 60:40.

The preferable ratio of the total of the components (A) and (D) in the finish of the present invention is 30 weight percent or more, and preferred is within the range from 45 to 70 weight percent. The ratio less than 30 weight percent will fail to attain sufficient heat resistance of the finish of the present invention. The possible ratio of the component (A) to the component (D) for emulsifying the component (A) is from 100:0 to 30:70 by weight. For preparing a stable emulsion of the component (A), the (A) to (D) ratio should be controlled within the range from 60:40 to 40:60 by weight.

The ratio of the components (B) and (C) in the finish of the present invention is not defined specifically. Higher ratio of the component (B) contributes to superior heat resistance of the finish, and higher ratio of the component (C) contributes to better spreadability of the finish. Although the said components (A), (B), and (C), are sufficient enough for formulating the finish which satisfy the requirements for solving the said troubles in carbon fiber production, silicone oils and antioxydants may be added to the finish of the present invention within the limit where their property does not inversely affect finish performance. The amount of the finish of the present invention to be applied to carbon fiber precursors is from 0.1 to 0.5 percent of precursor weight, and preferred is from 0.2 to 0.4 percent, which is lower and specified in narrower range than the preferable amount of silicone oils. Applying more than 0.5 percent of the finish of the present invention will reduce the tenacity of the resultant carbon fiber.

The invention will now be further described in the following specific examples which are to be regarded solely as illustrative and not as restricting the scope of the invention.

EXAMPLE 1

The mixture of the compositions (1) and (2), comprising the components as described below, wherein the ratio of the composition (1) to the composition (2) was 40 to 60 parts by weight, was prepared into a homogeneous aqueous emulsion.

The composition (1) comprised 70 weight percent of the component (B) of the present invention, i.e., the product from the reaction of oleic acid diethanol amide, and the condensate (having 30 acid value) of adipic acid and the 20-mol-ethylene-oxide adduct of hydrogenated castor oil wherein the molar ratio of the oleic acid diethanol amide to the adipic acid and to the ethylene oxide adduct of the condensation product was 0.8:1.5:1; and 30 weight percent of the component (C) of the present invention, i.e., the 10-mol-ethylene-oxide adduct of the product from the reaction of diethylenetriamine and stearic acid at 1:2 molar ratio.

The composition (2) comprised 60 weight percent of the component (A) of the present invention, i.e., the esterification product of adipic acid, and 2-mol-ethylene-oxide adduct of bisphenol A monolaurate at 1:2 molar ratio; and 40 weight percent of the component (D) of the present invention, i.e., the mixture of 50 weight percent of the 50-mol-ethylene-oxide adduct of bisphenol A, and 50 weight percent of the ethylene/propylene oxide block copolymer of about 10,000 molecular weight, having the ethylene oxide content such that the ethylene oxide in the copolymer constitutes 80 weight percent.

The prepared finish emulsion was applied to acrylic tow (consisting of 12,000 monofilaments of 1.3 denier ), to provide about 0.3 weight percent finish on the fiber. The finish-applied acrylic tow was then dried at 100°–140° C. to be prepared into a precursor. The precursor was then stabilized at 250°–280° C. for 30 minutes, followed by the carbonization in nitrogen atmosphere at a gradient temperature from 300° C.–1400° C. The precursor and the resultant carbon fiber were tested on their property, and the result is given in Tables 1 and 2.

The precursor and carbon fiber produced with the said finish displayed satisfiable property and adherability to matrix resins similar to that of carbon fibers produced with conventional precursor finishes. In addition, the finish resulted in much less deposit accumulation than conventional finishes.

EXAMPLE 2

The procedure of Example 1 was followed except that the ratio of the component (1) to the component (2) was modified into 55 to 45 by weight percent. The property of the precursor and carbon fiber applied with the finish is given in Tables 1 and 2.

EXAMPLE 3

The procedure of Example 1 was followed except that the ratio of the component (B) to the component (C) of the composition (1) was modified into 80 to 20 by weight percent. The property of the precursor and carbon fiber applied with the finish is given in Tables 1 and 2.

EXAMPLE 4

The procedure of Example 1 was followed except that the ratio of the component (B) to the component (C) of the composition (1) was modified into 60 to 40 weight percent. The property of the precursor and carbon fiber applied with the finish is given in Tables 1 and 2.

EXAMPLE 5

The procedure of Example 1 was followed except that the component (B) was replaced with the product from the reaction of stearic acid diethanol amide, and a condensate (having 30 acid value) of adipic acid and a 30-mol-ethylene-oxide adduct of trimethylol propane, wherein the molar ratio of the stearic acid diethanol amide to the adipic acid and ethylene oxide adduct of the condensate was 0.8 to 1.5 to 1. The property of the precursor and carbon fiber is given in Tables 1 and 2.

EXAMPLE 6

The procedure of Example 1 was followed except that the component (B) was replaced with the product from the reaction of oleic acid diethanol amide, and a condensate (having 40 acid value) of sebacic acid and 30-mol-ethylene-oxide adduct of hydrogenated castor oil, wherein the molar ratio of the oliec acid diethanol amide to the sebacic acid and ethylene oxide adduct of the condensate was 0.9 to 1.5 to 1. The property of the precursor and carbon fiber is given in Tables 1 and 2.

EXAMPLE 7

The procedure of Example 1 was followed except that the finish emulsion was prepared without the composition (1), in other words, the finish emulsion was prepared only with the composition (2) comprising 60 weight percent of the component (A), i.e., the esterification product of adipic acid, and 2-mol-ethylene-oxide adduct of bisphenol A monolaurate at 1 to 2 molar ratio; and 40 weight percent of the component (D), i.e., the mixture of 50 weight percent of the 50-mol-ethylene-oxide adduct of bisphenol A, and 50 weight percent of an ethylene/propylene oxide block copolymer of about 10,000 molecular weight having the ethylene oxide content such that the ethylene oxide in the copolymer constituted 80 weight percent. The property of the precursor and carbon fiber is given in Tables 1 and 2.

EXAMPLE 8

The procedure of Example 1 was followed except that the finish was formulated with 20 weight percent of the component.(B) of Example 1 and 80 weight percent of the composition (2) of Example 1. The property of the precursor and carbon fiber is given in Tables 1 and 2.

EXAMPLE 9

The procedure of Example 1 was followed except that the finish was formulated with 50 weight percent of the component (B) of Example 1 and 50 weight percent of the composition (2) of Example 1. The property of the precursor and carbon fiber is given in Tables 1 and 2.

EXAMPLE 10

The procedure of Example 1 was followed except that the finish was formulated with 10 weight percent of the component (C) of Example 1 and 90 weight percent of the composition (2) of Example 1. The property of the precursor and carbon fiber is given in Tables 1 and 2.

EXAMPLE 11

The procedure of Example 1 was followed except that the finish was formulated with 30 weight percent of the component (C) of Example 1 and 70 weight percent of the composition (2) of Example 1. The property of the precursor and carbon fiber is given in Tables 1 and 2.

EXAMPLE 12

The procedure of Example 1 was followed except that the component (B) was replaced with the product from the reaction of oleic acid diethanolamide, and a condensate (having 30 acid value) of phthalic acid and 20-mol-ethylene-oxide adduct of hydrogenated castor oil, wherein the molar ratio of the oleic acid diethanol amide to the phthalic acid and ethylene-oxide adduct of the condensate was 0.8 to 1.5 to 1. The property of the precursor and carbon fiber is given in Tables 1 and 2.

EXAMPLE 13

The procedure of Example 1 was followed except that the component (C) was replaced with 20-mol-ethylene-oxide adduct of an amide from the reaction of diethylene triamine and behenic acid in 1 to 2 molar ratio. The property of the precursor and carbon fiber is given in Tables 1 and 2.

EXAMPLE 14

The procedure of Example 1 was followed except that the composition (2) was replaced with the methylethyl keton (MEK) solution of the component (A) of Example 1, the esterification product of adipic acid and 2-mol-ethylene-oxide adduct of bisphenol A monolaurate in 1 to 2 molar ratio. The property of the precursor and carbon fiber is given in Tables 1 and 2.

EXAMPLE 15

The procedure of Example 1 was followed except that the finish was prepared by dissolving only the component (A) of the composition (2) in MEK. The property of the resultant precursor and carbon fiber is given in Tables 1 and 2.

EXAMPLE 16

The procedure of Example 1 was followed except that the finish was prepared by dissolving 40 parts by weight of the component (B) of the composition (1) and 60 parts by weight of the component (A) of the composition (2) in MEK. The property of the resultant precursor and carbon fiber is given in Tables 1 and 2.

EXAMPLE 17

The procedure of Example 1 was followed except that the finish was prepared by dissolving 40 parts by weight of the component (C) of the composition (1) and 60 parts by weight of the component (A) of the composition (2) in MEK. The property of the resultant precursor and carbon fiber is given in Tables 1 and 2.

EXAMPLE 18

The procedure of Example 1 was followed except that the component (A) was replaced with the ester produced by reacting azelaic acid and the 2-mol-ethylene oxide adduct of the monopalmitate of bisphenol A at 1 to 2 molar ratio. The property of the precursor and carbon fiber is given in Tables 1 and 2.

EXAMPLE 19

The procedure of Example 1 was followed except that the component was replaced with the ester produced by reacting adipic acid and the 1-mol-ethylene-and-propylene-oxide adduct of the monolaurate of phenol A at 1 to 2 molar ratio. The property of the precursor and carbon fiber is given in Tables 1 and 2.

COMPARATIVE EXAMPLE 1

The procedure of Example 1 was followed except that the finish of Example 1 was replaced with the aqueous emulsion of an amino-modified silicone, of which amino equivalent was 1,800 and viscosity was 1,200 cSt at 25° C., being emulsified with a nonionic surfactant. The amino equivalent represents the grams of a silicone containing 1 mol of $NH_3$. The property of the resultant precursors and carbon fibers is given in Tables 1 and 2.

COMPARATIVE EXAMPLE 2

The procedure of Example 1 was followed except that the finish of Example 1 was replaced with the aqueous emulsion of the amino-modified silicone, of which amino equivalent was 3,000 and viscosity was 3,500 cSt at 25° C., being emulsified with a nonionic surfactant. The property of the resultant precursors and carbon fibers is given in Tables 1 and 2.

COMPARATIVE EXAMPLE 3

The procedure of Example 1 was followed except that the finish of Example 1 was replaced with the mixture of 60 weight percent of stearic acid diethanolamide, and 40 weight percent of the 50-mol-ethylene-oxide adduct of bisphenol A. The property of the resultant precursors and carbon fibers is given in Tables 1 and 2.

COMPARATIVE EXAMPLE 4

The procedure of Example 1 was followed except that the blend ratio of the compositions (1) and (2) was modified into 75 to 25, wherein the component (A) was contained in 15 weight percent, and the finish pickup was controlled at 0.40 percent of fiber weight. The property of the resultant precursors and carbon fibers is given in Tables 1 and 2.

TABLE 1

| | Property of Precursors | | | |
|---|---|---|---|---|
| | FOF (%)* | Fluffs/ Breakage | Deposit | Fusion/ Adhesion |
| Example 1 | 0.32 | none | 1 | none |
| Example 2 | 0.31 | none | 1 | none |
| Example 3 | 0.30 | none | 1 | none |
| Example 4 | 0.32 | none | 1 | none |
| Example 5 | 0.29 | none | 1 | none |
| Example 6 | 0.33 | none | 1 | none |
| Example 7 | 0.31 | none | 1 | none |
| Example 8 | 0.30 | none | 1 | none |
| Example 9 | 0.34 | none | 1 | none |
| Example 10 | 0.31 | none | 1 | none |
| Example 11 | 0.33 | none | 1 | none |
| Example 12 | 0.29 | none | 1 | none |
| Example 13 | 0.34 | none | 1 | none |
| Example 14 | 0.31 | none | 1 | none |
| Example 15 | 0.31 | a little | 1 | none |
| Example 16 | 0.30 | none | 1 | none |
| Example 17 | 0.31 | a little | 1 | none |
| Example 18 | 0.32 | none | 1 | none |
| Example 19 | 0.31 | none | 3 | none |
| Comparative Example 1 | 1.12 | none | 5 | none |
| Comparative Example 2 | 1.02 | none | 5 | none |
| Comparative Example 3 | 0.31 | medium | 3 | medium |
| Comparative Example 4 | 0.40 | a little | 3 | medium |

*FOF represents finish on fiber based on fiber weight.

TABLE 2

| | Property of Carbon fibers | |
|---|---|---|
| | Tenacity (kg/mm$^2$) | Fusion/Adhesion |
| Example 1 | 505 | none |
| Example 2 | 505 | none |
| Example 3 | 495 | none |
| Example 4 | 510 | none |
| Example 5 | 500 | none |
| Example 6 | 505 | none |
| Example 7 | 480 | none |
| Example 8 | 503 | none |
| Example 9 | 507 | none |
| Example 10 | 508 | none |
| Example 11 | 505 | none |
| Example 12 | 495 | none |
| Example 13 | 490 | none |
| Example 14 | 485 | none |
| Example 15 | 460 | none |
| Example 16 | 495 | none |
| Example 17 | 470 | none |
| Example 18 | 515 | none |
| Example 19 | 490 | none |
| Comparative Example 1 | 500 | none |
| Comparative Example 2 | 495 | none |
| Comparative Example 3 | 395 | adhered |
| Comparative Example 4 | 455 | adhered |

TABLE 3

| Deposit Ranking | |
|---|---|
| rank | Deposit generation |
| 1 | Rarely observed after 8 hours operation |
| 2 | Slightly observed after 8 hours operation, though not observed after 4 hours operation. |
| 3 | Observed after 4 hours operation. |
| 4 | Slightly observed after 4 hours operation, though not observed after 1 hour operation. |
| 5 | Observed after 1 hour operation. |

TEST METHODS

Fluffs and Breakage

A 1000-m precursor sample was driven through a fluff counter, the tester produced by Toray Co., Ltd., and the fluffs of 2 mm or longer were counted.

Deposit

The deposit of the finishes, which accumulated on a chromium-plated mirror-finished roll employed in the production process of carbon fiber precursor of the pilot plant where the carbon fiber production test of the above Examples were conducted, was visually inspected. The deposit accumulation was ranked into 5 groups as described in Table 3.

Adhesion of Precursor

The adhesion of precursor was observed through electron microscope.

Tenacity of Carbon Fiber Strand

The tenacity of resultant carbon fiber strand was tested according to the procedure defined in JIS K7071.

Fusion and Adhesion of Carbon Fiber

The fusion and adhesion of carbon fiber was visually inspected.

What is claimed is:

1. A finish for carbon fiber precursors comprising 20 or more weight percent of (A) the reaction product of a saturated aliphatic dicarboxylic acid, and a monoalkyl ester of an ethylene oxide and/or propylene oxide adduct of bisphenol A, represented by the general formula I;

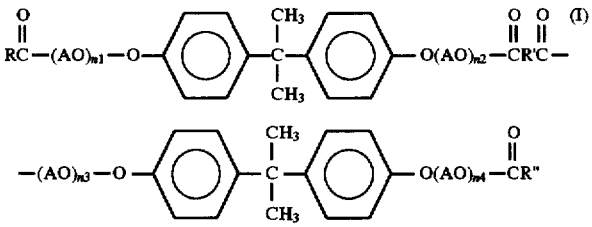

wherein R, R', and R" are the same or different alkyl groups: $n_1$, $n_2$, $n_3$, and $n_4$ are the same or different integer; and AO is an alkylene oxide group including 20 to 50 weight percent of (B) the component produced by the reaction of the condensation product of a dibasic acid and a polyol containing alkylene oxide, and fatty acid alkylol amide.

2. A finish for carbon fiber precursors comprising 20 or more weight percent of (A) the reaction product of a saturated aliphatic dicarboxylic acid, and a monoalkyl ester of an ethylene oxide and/or propylene oxide adduct of bisphenol A, represented by the general formula I:

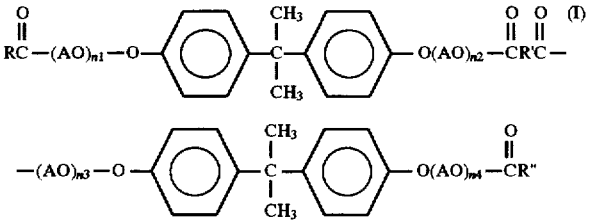

wherein R, R', and R" are the same or different alkyl groups: $n_1$, $n_2$, $n_3$, and $n_4$ are the same or different integer; and AO is an alkylene oxide group, further including 5 to 30 weight percent of (C) an alkylene oxide adduct of an amide produced with the reaction of a polyamine and a fatty acid.

3. A finish for carbon fiber precursors comprising 20 or more weight percent of (A) the reaction product of a saturated aliphatic dicarboxylic acid and a monoalkyl ester of an ethylene oxide and/or propylene oxide adduct of bisphenol A, represented by the general formula I;

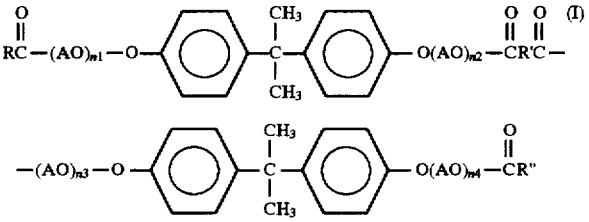

wherein R, R', and R" are the same or different alkyl groups: $n_1$, $n_2$, $n_3$, and $n_4$ are the same or different integer; and AO is an alkylene oxide group, wherein 20 to 60 weight percent of the component (A) is contained, and further including 20 to 50 weight percent of the component (B) and 5 to 30 weight percent of the component (C).

4. A finish for carbon fiber precursors comprising 20 or more weight percent of (A) the reaction product of a saturated aliphatic dicarboxylic acid, and a monoalkyl ester of an ethylene oxide and/or propylene oxide adduct of bisphenol A represented by the general formula I;

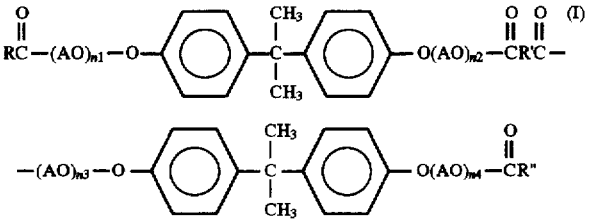

wherein R, R', and R" are the same or different alkyl groups: $n_1$, $n_2$, $n_3$, and $n_4$ are the same or different integer; and AO is an alkylene oxide group, wherein 5 to 30 weight percent of (D) the mixture of 0 to 100 parts by weight of ethylene oxide adduct of bisphenol A, and 100 to 0 parts by weight of ethylene oxide/propylene oxide copolymer are contained.

5. The aqueous emulsion of the finish defined in claim 4, wherein the components (A), (B), (C), and (D) are contained in 20 to 60 weight percent, 20 to 50 weight percent, 5 to 30 weight percent, and 5 to 30 weight percent each in the order.

6. A method of preparing carbon fibers which comprises applying a finish for carbon fiber precursors comprising 20 or more weight percent of (A) the reaction product of a saturated aliphatic dicarboxylic acid, and a monoalkyl ester of an ethylene oxide and/or propylene oxide adduct of bisphenol A, represented by the general formula I;

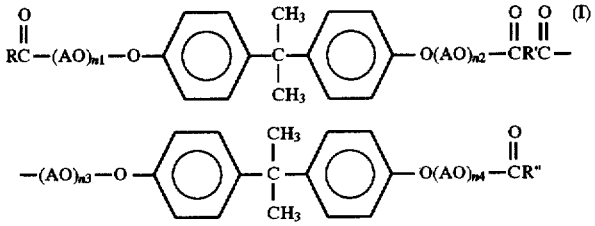

wherein R, R', and R" are the same or different alkyl groups; $n_1$, $n_2$, $n_3$, and $n_4$ are the same or different integer; and AO is an alkylene oxide group, on the surface of carbon fiber precursors, and carbonizing them.

7. The method of claim 6, in which the finish is applied in the form of aqueous emulsion.

8. The method of claim 6, in which the finish is applied to the precursors in the amount of from 0.1 to 0.5 percent by weight of the precursor weight.

9. The method of claim 6, in which the finish is applied to the precursors, the precursors are stabilized, and then carbonized in nitrogen atmosphere at a gradient temperature from 300° C. to 1400° C.

10. The method of claim 6, in which the carbon fiber precursors are acrylic tow.

11. A method of preparing carbon fibers which comprises applying a finish comprising a finish for carbon fiber precursors comprising 20 or more weight percent of (A) the reaction product of a saturated aliphatic dicarboxylic acid, and a monoalkyl ester of an ethylene oxide and/or propylene oxide adduct of bisphenol A, represented by the general formula I;

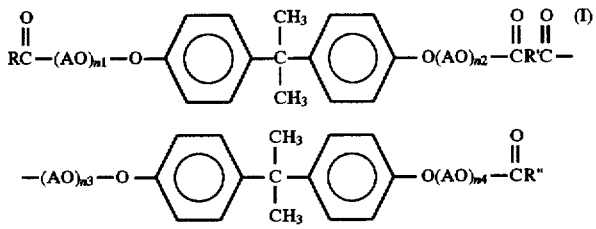

wherein R, R', and R" are the same or different alkyl groups; $n_1$, $n_2$, $n_3$, and $n_4$ are the same or different integer; and AO is an alkylene oxide group, including 20 to 50 weight percent of (B) the component produced by the reaction of the condensation product of a dibasic acid and a polyol containing alkylene oxide, and fatty acid alkylol amide.

12. A method of preparing carbon fibers which comprises applying a finish comprising a finish for carbon fiber precursors comprising 20 or more weight percent of (A) the reaction product of a saturated aliphatic dicarboxylic acid, and a monoalkyl ester of an ethylene oxide and/or propylene oxide adduct of bisphenol A, represented by the general formula I;

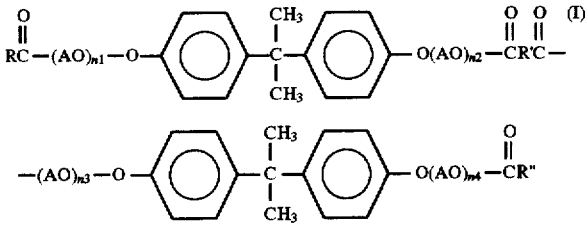

wherein R, R', and R" are the same or different alkyl groups; $n_1$, $n_2$, $n_3$, and $n_4$ are the same or different integer; and AO is an alkylene oxide group, further including 5 to 30 weight percent of (C) an alkylene oxide adduct of an amide produced with the reaction of a polyamine and a fatty acid.

13. A method of preparing carbon fibers which comprises applying a finish comprising a finish for carbon fiber precursors comprising 20 or more weight percent of (A) the reaction product of a saturated aliphatic dicarboxylic acid, and a monoalkyl ester of an ethylene oxide and/or propylene oxide adduct of bisphenol A, represented by the general formula I;

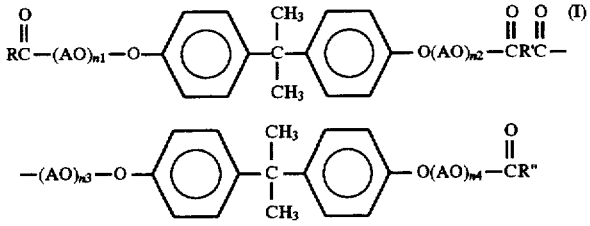

wherein R, R', and R" are the same or different alkyl groups; $n_1$, $n_2$, $n_3$, and $n_4$ are the same or different integer; and AO is an alkylene oxide group, wherein 20 to 60 weight percent of the component (A) is contained, and further including 20 to 50 weight percent of the component (B) and 5 to 30 weight percent of the component (C).

* * * * *